US007104854B2

(12) United States Patent
Saito

(10) Patent No.: US 7,104,854 B2
(45) Date of Patent: Sep. 12, 2006

(54) HYDRAULIC SYSTEM FOR MARINE PROPULSION UNIT

(75) Inventor: Hideaki Saito, Kakegawa (JP)

(73) Assignee: SOQI Kabushiki Kaisha, Kakegawa (JP)

( * ) Notice: Subject to any disclaimer, the term of this patent is extended or adjusted under 35 U.S.C. 154(b) by 69 days.

(21) Appl. No.: 10/711,340

(22) Filed: Sep. 12, 2004

(65) Prior Publication Data

US 2005/0090165 A1 Apr. 28, 2005

(30) Foreign Application Priority Data

Oct. 22, 2003 (JP) ..... 2003-362545

(51) Int. Cl.
*B63H 20/08* (2006.01)

(52) U.S. Cl. ..... 440/61 R; 440/53

(58) Field of Classification Search ..... 440/53, 440/61 R, 65

See application file for complete search history.

(56) References Cited

U.S. PATENT DOCUMENTS 4,064,824 A * 12/1977 Hall et al. ..... 440/61 R
4,395,239 A * 7/1983 Hall et al. ..... 440/61 R
4,498,871 A * 2/1985 Hall et al. ..... 440/61 R
4,631,035 A * 12/1986 Nakahama ..... 440/61 R
4,702,714 A * 10/1987 Nakase ..... 440/61 R
4,909,766 A * 3/1990 Taguchi ..... 440/61 R
6,213,823 B1 * 4/2001 Nakamura et al. ..... 440/61 R
6,328,616 B1 * 12/2001 Nakamura et al. ..... 440/61 R

FOREIGN PATENT DOCUMENTS

JP 07-69289 3/1995

* cited by examiner

*Primary Examiner*—Lars A. Olson
(74) *Attorney, Agent, or Firm*—Ernest A Beutler

(57) ABSTRACT

An improved hydraulic system for a marine propulsion unit where it is insured that leakage of the shuttle valve will not permit the propulsion unit to move from the desired position by having a series of shuttle piston operated check valves inn series flow between the pump and the hydraulic unit that controls the position.

8 Claims, 6 Drawing Sheets

HYDRAULIC SYSTEM FOR MARINE PROPULSION UNIT

BACKGROUND OF INVENTION

This invention relates to a hydraulic system for a marine propulsion unit and more particularly to a system that insures against unwanted downward movement due to valve leakage.

As is well known many marine propulsion systems, particularly ones having larger displacements employ hydraulically operated trim and tilt controls. These systems generally permit trim adjustment when the watercraft is in motion and tilting up out of the water for trailering or service. In addition they generally incorporate a pop up damping arrangement that permits the propulsion unit to pop up when an underwater obstacle is encountered to prevent damage and return to the trim adjusted position when it is cleared.

One such arrangement is shown in Published Japanese Application, publication number Hei 07-69289, published Mar. 14, 1995. As shown in that publication, the tilt and trim arrangement comprises a clamp bracket fixed to the watercrafthull and on which a propulsion unit is pivotally supported for the trim and tilt operation. This is accomplished by a tilt cylinder mounted with its axis extending in a generally vertical direction and capable of expanding and retracting in the axial direction. The lower end of the cylinder is pivotally supported by the clamp bracket through a lower pivot and its upper end is pivotally connected to the propulsion unit through an upper pivot. A pressurized oil control system for controlling oil delivery to accomplish the desired motion.

The tilt cylinder includes a cylinder body forming a large cylinder bore into which a large trim piston is fitted. A small cylinder bore is formed around the axis in a part of the cylinder body above the large cylinder bore with its upper end externally opened and its lower end communicating with the large cylinder bore. A cylinder tube with its upper end closed is fitted into and inserted through the small cylinder bore and connected to the large piston. A small piston is fitted into a separate cylinder bore in the cylinder tube. A piston rod is provided, which has an end extending upward from the small piston through the closure, is pivotally connected to the propulsion unit by the upper pivot.

However, when the trim cylinder is operated to expand/retract in order to adjust the trim position of the propulsion unit, the propulsion unit swings up and down as the piston repeatedly slides with respect to the inner peripheral surface of the cylinder bore through the sealing body with friction, as described above. The same occurs during repeated tilt up and down operations as well as popping up and return operations as occur when underwater obstacles are encountered and cleared. Therefore, extended and repeated use of the unit may often produce a minute foreign matter resulting from the wearing of the inner peripheral surface of the cylinder bore or the sealing body.

The fluid control system includes a shuttle valve assembly that incorporates a pair of oppositely opening check valves that are positioned on opposite sides of a shuttle piston. When one side is pressurized its associated check will open to supply fluid pressure to effect operation of the unit to move the propulsion unit inn the desired direction. The shuttle piston will then shift to forcibly open the other check valve to provide a return fluid path to the pump. When the desired position is reached the pump is stopped and the check valves close to retain the propulsion unit in the desired position. In the extreme case this may be the tilted up out of the water position where it is intended to be maintained for a long time, for example when in storage.

However the aforenoted foreign matter may either cause pitting of the ball check valve, wear of its seat or become lodged between the desired sealing surfaces. This can result in minute leakage that will cause the propulsion unit to gradually move from its desired position, an obviously unsatisfactory condition. Although frequent servicing of the unit and inspection could avoid this problem, this is not always done and can be expensive.

It is therefore a principal object of this invention to provide a simple and low cost hydraulic solution to this problem that reduces the necessity of frequent and expensive servicing.

SUMMARY OF INVENTION

This invention is adapted to be embodied in a hydraulic system for controlling the position of an outboard drive on the hull of a watercraft. The system comprises a cylinder body assembly defining a cylinder bore in which a piston is supported for reciprocation. The piston divides the cylinder bore into two chambers on opposite sides of the piston. A piston rod is affixed to the piston and extends through one of the chambers and externally of the cylinder body assembly for connection to one of the outboard drive and the hull. The cylinder body assembly is connected to the other of the outboard drive and the hull for effecting movement of the outboard drive relative to the hull upon pressurization of one of the chambers. A hydraulic system selectively pressurizes the one chamber to elevate the outboard drive relative to the hull. The hydraulic system comprises a pump for pressurizing fluid and a valved system for communicating the output of the pump with the one chamber comprising a first check valve interposed between the pump and the one chamber and adapted to be opened upon pressurization for flow toward the one chamber. A second check valve is interposed between the first check valve and the one chamber and adapted to be opened upon pressurization for flow toward the one chamber. At least one of the first and the second check valves preclude flow from the one chamber when not pressurized

DETAILED DESCRIPTION

Figure 1:
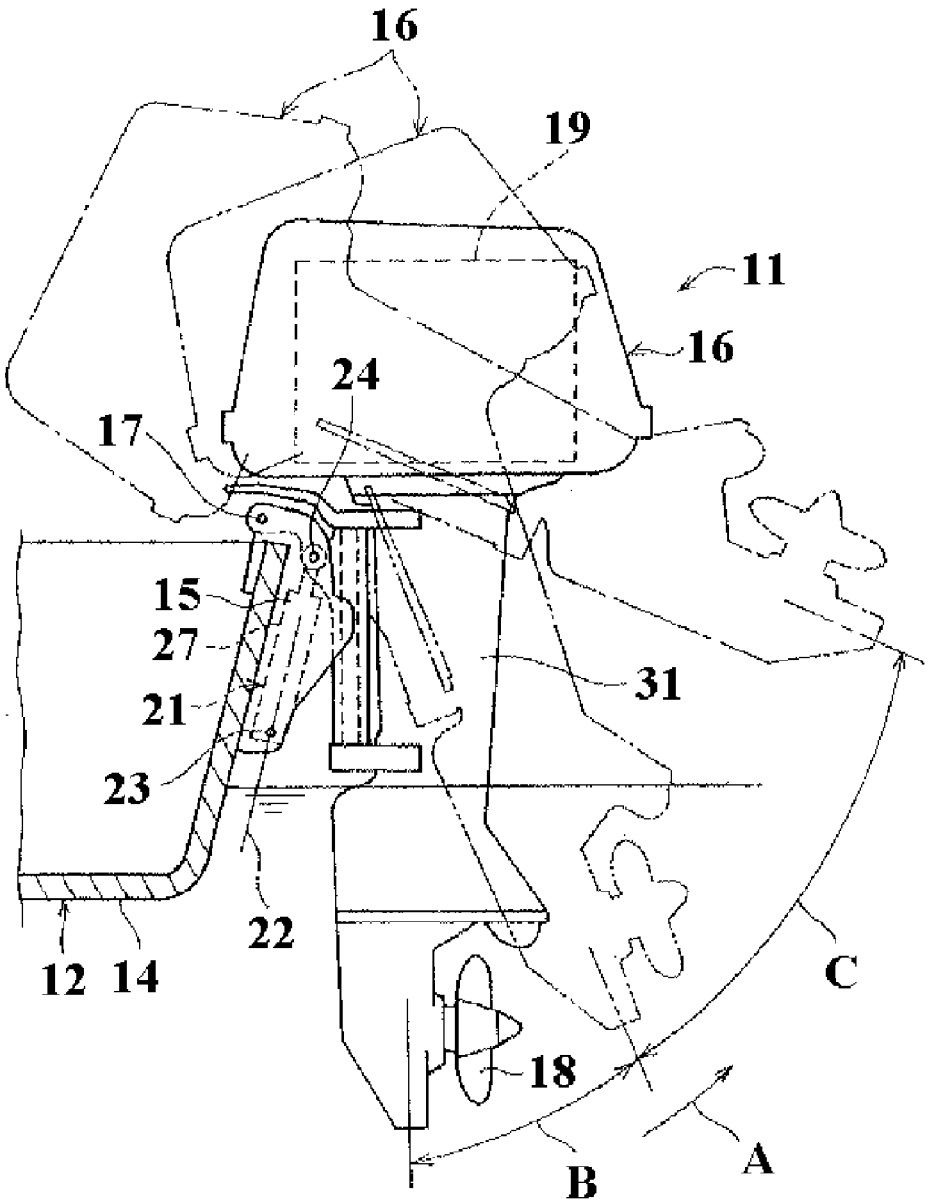
FIG. 1 is a side elevational view of a portion of a watercraft (shown partially and in cross section) with a propulsion unit attached utilizing a tilt and trim unit constructed in accordance with the invention, showing the range of trim and tilt movements in phantom lines.

Referring now in detail to the drawings and initially to FIG. 1, a watercraft propulsion unit in the form of an outboard motor 11 for propelling a watercraft such as a boat, indicated generally at 12 is supported on a transom 13 formed at a rear of a hull 14 of the boat 12. The outboard motor 11 includes, as part of its tilt and trim apparatus, a clamp bracket 15 removably mounted to the rear of the transom 13 of the hull 14 by means of fasteners (not shown).

As is well known in the art, the outboard motor 11 includes a propulsion unit, indicated generally at 16 provided at a rear of the clamp bracket 15 and pivotally supported by an upper part of the clamp bracket 15 by means of a pivot pin 17 to allow a propulsion device such as a propeller 18 at the lower part of the propulsion unit 16 to pivot in a manner to be described. The propeller 18 is driven in any desired manner such as by an internal combustion engine, indicated schematically at 19.

The upward pivotal movement from the fully tilted and trimmed down position shown in solid lines in FIG. 1 is rearward and upward in the direction of the arrow A in this figure through a trim range B and a fully tilted up range C. This movement is effected and controlled by a hydraulic tilt and trim cylinder constructed in accordance with the invention and indicated generally by the reference numeral 21. The tilt and trim cylinder is mounted with its axis 22, to be described in more detail later by reference to the remaining figures, extending in a generally vertical direction with its lower end pivotally supported by a lower part of the clamp bracket 15 by means of a lower pivot 23, as is well known in the art and in a specific manner to be described in more detail later. A piston rod (to be identified in more detail later) of the tilt and trim cylinder assembly 21 has its upper end pivotally connected to the propulsion unit 16 by means of an upper pivot 24, in a manner as will also be described in more detail later. As will be described later by reference to FIG. 6, a pressurized oil control system controls delivery to/or exhaust from the chambers, to be described, of the tilt and trim cylinder 21 to operate the tilt and trim cylinder 21.

Figure 2:
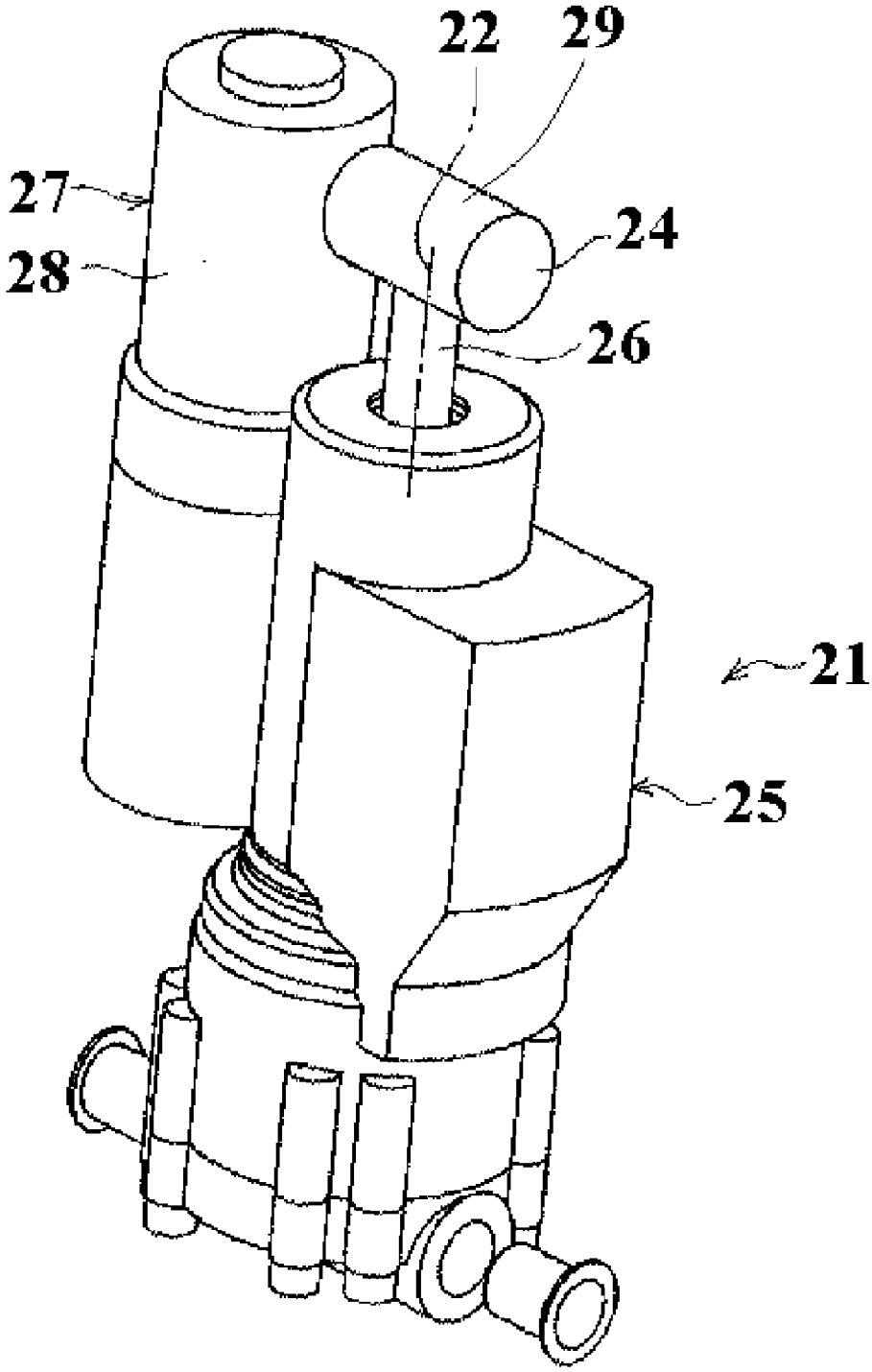
FIG. 2 is a perspective view of the trim and tilt unit.

Referring now to FIG. 2, this shows in perspective, the tilt and trim cylinder 21 that includes a cylinder body, indicated generally by the reference numeral 25, and from which the aforenoted piston rod 26 extends in a generally upward direction. Mounted to one side of the cylinder body 25 are some components of a hydraulic control system, indicated generally at 27. This system 27 includes a housing 28 that contains a reversible electric motor (not shown).

As seen in this figure the upper pivot 24 is pivotally carried in a trunion 29 formed on the upper end of the piston rod 26. This upper pivot 24 has its opposite ends journalled in a manner to be described in a drive shaft housing 31 of the outboard motor 11 (see FIG. 1).

Figure 3:
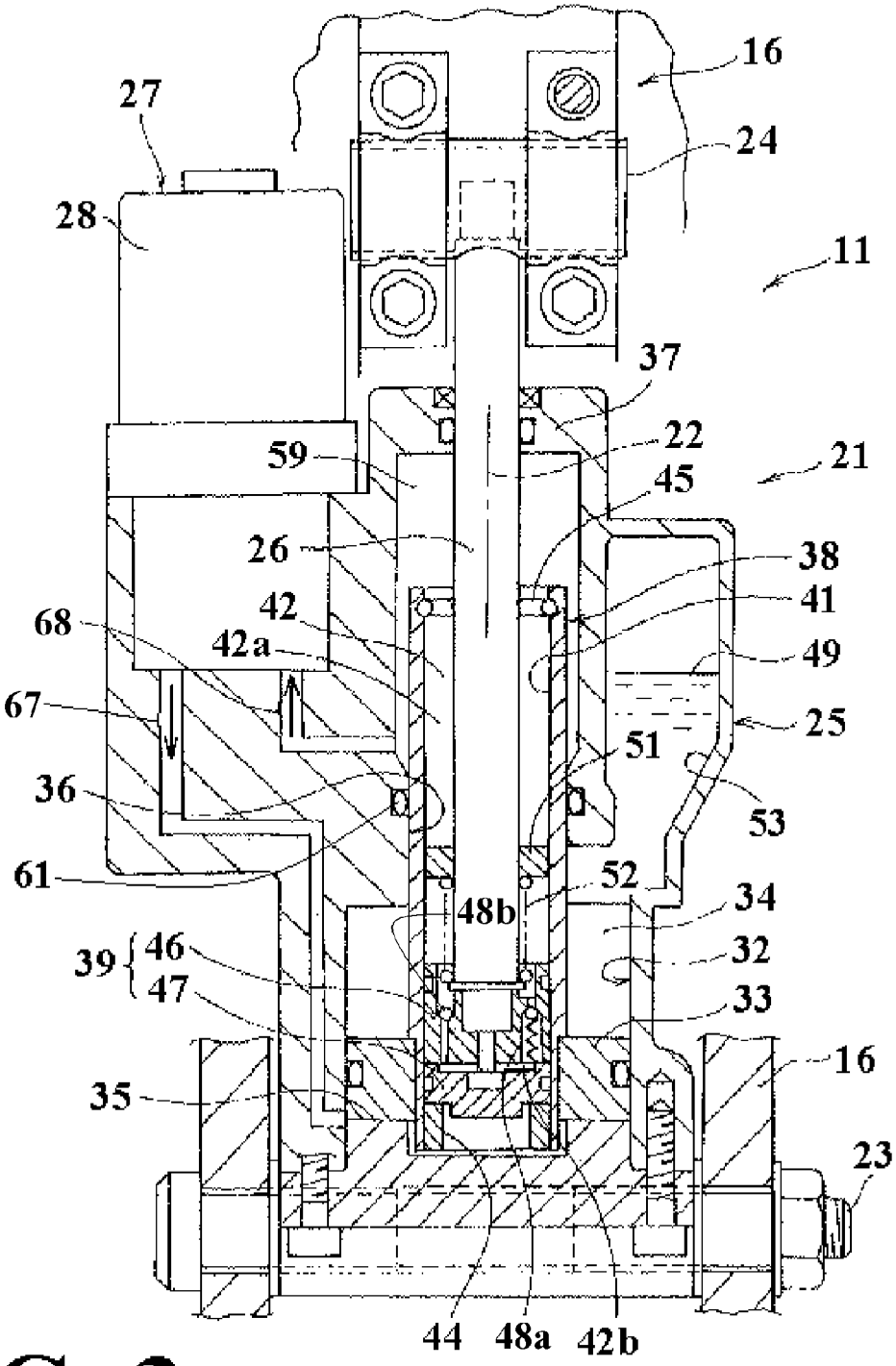
FIG. 3 is a cross sectional view of the tilt and trim unit taken through a transverse axis of the cylinder, showing the fully trimmed and tilted down position.

Referring now to FIG. 3 and as has already been noted, the tilt and trim cylinder 21 includes a cylinder body 25 that forms its outer shell and which is pivotally supported by the lower part of the clamp bracket 15 by means of the lower pivot 23. The cylinder body 25 has a larger diameter cylinder bore 32 formed around the axis 22, into which a large diameter piston 33 is fitted for reciprocation in the axial direction. The piston 33 divides the large cylinder bore 32 into an upper chamber 34 and a lower chamber 35.

A smaller diameter cylinder bore 36 is formed around the axis 22 in a part of the cylinder body 25 above the large cylinder bore 32 with its upper end closed by an integral end wall 37 of cylinder body 25 with its lower end communicating with an upper end of the large cylinder bore 32. A cylinder tube 38 is reciprocally fitted into the small cylinder bore 36 for movement in the axial direction and is fixed to the large piston 33. A small piston, indicated generally at 39, is supported for reciprocation in a smaller cylinder bore 41 formed in the cylinder tube 38. The small piston 39 divides the smaller cylinder bore 41 into upper and lower bore portions 42 and 43, respectively.

The piston rod 26 is fixed to and extends upward from the small piston 39 through the end wall 37 along the axis 22. The upper, exposed end of the piston rod 26, as has been noted, provides the pivotal connection to the propulsion unit 16 through the upper pivot 24.

A stopper ring 44 is fixed in the smaller cylinder bore 41 of the cylinder tube 38 to limit the downward movement of the small piston 39 In a like manner, an upper stopper ring 45 is provided to prevent the small piston 39 from moving up further than an upper predetermined position in the smaller cylinder bore 41.

The small piston 39 is comprised of upper and lower piston portions 46 and 47 that are each individually reciprocal in the smaller cylinder bore 41. The upper piston portion 46 divides the upper bore portion 42 of the smaller cylinder bore 41 into upper and lower areas 42*a* and 42*b*, respectively. The piston rod 26 extends upward from the upper piston portion 46 through both the lower bore area 42*b* and the upper bore area 42*a*. The stopper ring 45 prevents the upper piston portion 46 of the small piston 39 from moving up further than the predetermined position in the smaller cylinder bore 41.

Figure 4:
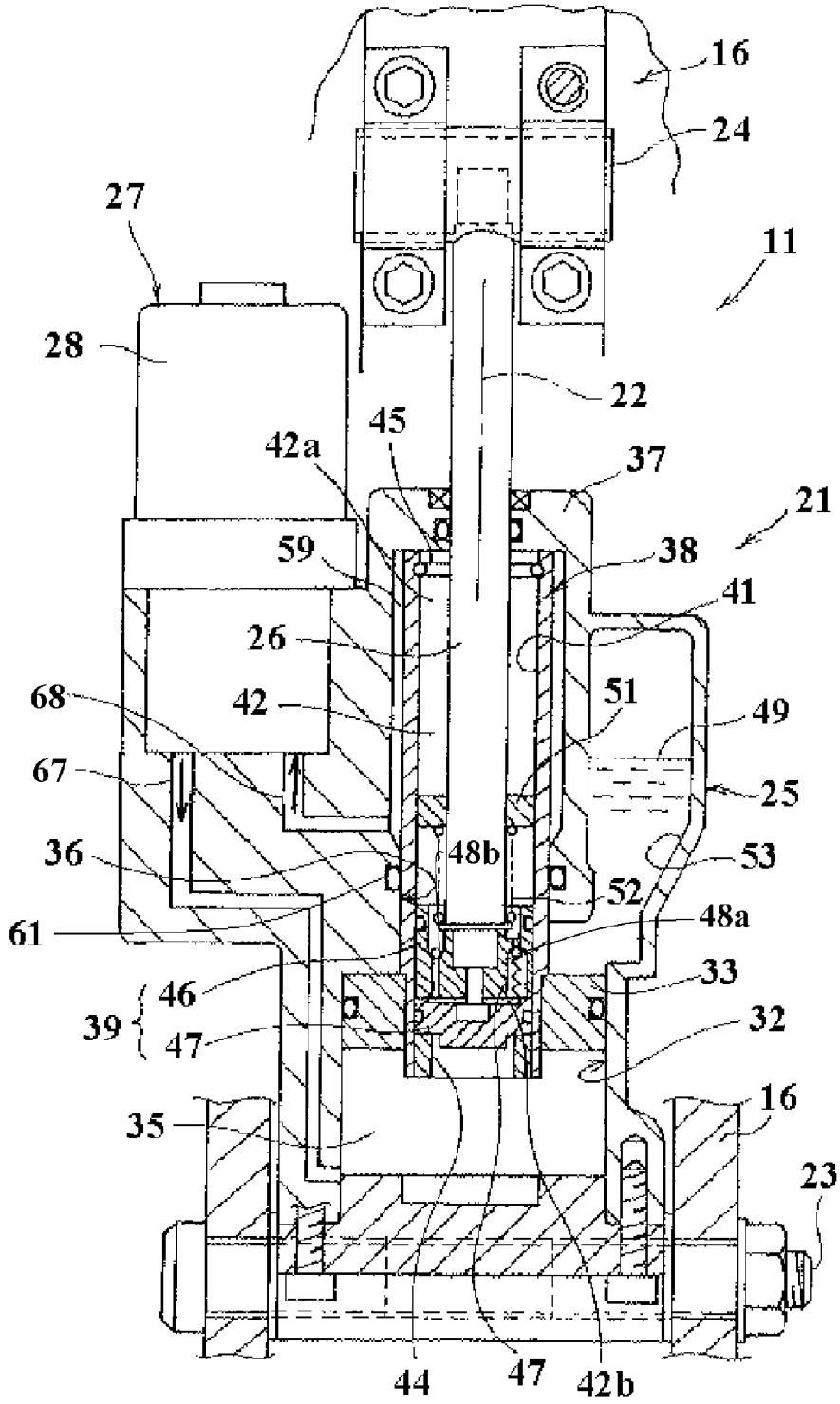
FIG. 4 is a cross sectional view, in part similar to FIG. 3, but showing the fully trimmed up position.
Figure 5:
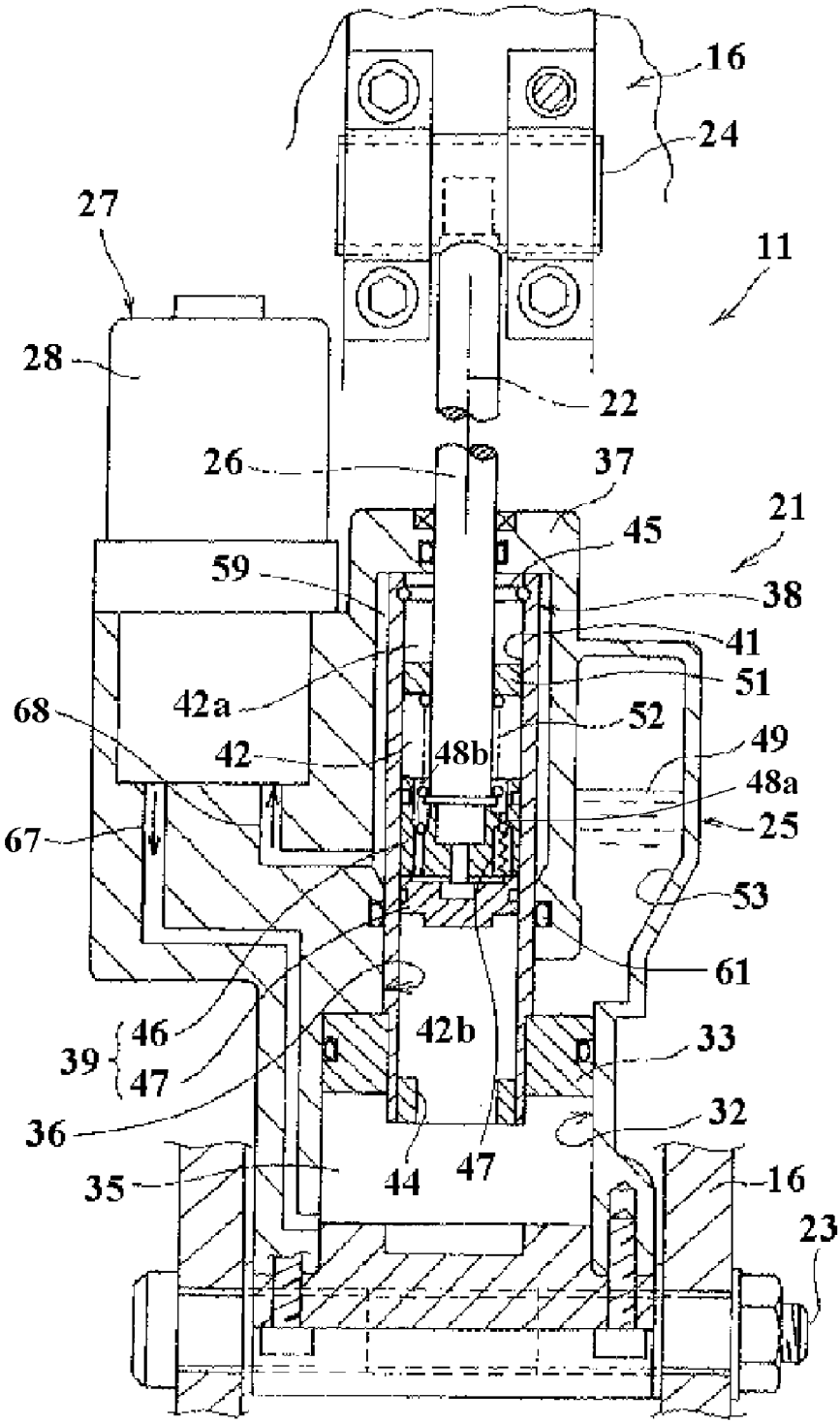
FIG. 5 is a cross sectional view, in part similar to FIGS. 3 and 4, but showing the fully tilted up position.

Referring now additionally to FIGS. 4 and 5, a flow control, damping check valve 48 is disposed in a passage that extends vertically through the upper piston portion 46 for controlling the flow of oil, indicated by the reference numeral 49 between the upper and lower bore areas 42*a* and 42*b* of the upper bore portion 42. The flow control, damping check valve 48 includes a spring-loaded check valve element 48*a* for permitting only an oil 49 flow from the upper bore area 42*a* toward the lower bore area 42*b* of the upper bore portion 42 through a small hole for pop up damping purposes when an underwater obstacle is encountered.

An unbiased second, let down check valve 48*b* permits oil 49 to flow from the lower bore area 42*b* toward the upper bore area 42*a* through a separate small hole. This permits return from the popped up position when the underwater obstacle is cleared. In addition to permitting popping up of the drive when an underwater obstacle is encountered, the damping check valve resists popping up when operating in reverse.

In order to prevent direct metal to metal contact upon extreme pop up action and to cushion the stopping of such movement, an oil lock piston 51 is fitted into the upper bore area 42*a* of the upper bore portion 42 and normally disposed at a gap above the upper piston portion 46. An annular gap is formed between the inner peripheral surface of the upper bore portion 42 and the outer peripheral surface of the oil lock piston 51 for permitting oil 49 to flow past the oil lock piston 51.

If the oil lock piston 51 is tending to move up further than the upper predetermined position in the upper end in the upper bore portion 42 of the smaller cylinder bore 41, the oil lock piston 51 abuts directly with the stopper ring 45 and thus is prevented from moving up further. Since the oil lock piston 51 is thus prevented from moving up, the upper piston portion 46 is also prevented from moving up further.

A light cushion spring 52 with a low spring constant is interposed between the upper piston portion 46 and the oil lock piston 51 for elastically supporting the oil lock piston 51 above the upper piston portion 46. The cushioning spring 52 is received in recess 46*a* is formed in an upper surface of the upper piston portion 46 of the small piston 39 when the spring 52 is elastically contracted fully in a vertical direction. The receiving recess 46*a* may be formed in either of the upper piston portion 46 or the oil lock piston 51.

The structure of the construction as thus far described and the way that the tilt and trim operation as well as the popping up action and return when underwater obstacles are met and cleared is as described in my co-pending applications filed concurrently herewith under Ser. Nos. 10/711,335 and 10/711,337 and assigned to the assignee hereof, which disclosures are incorporated herein by reference.

Figure 6:
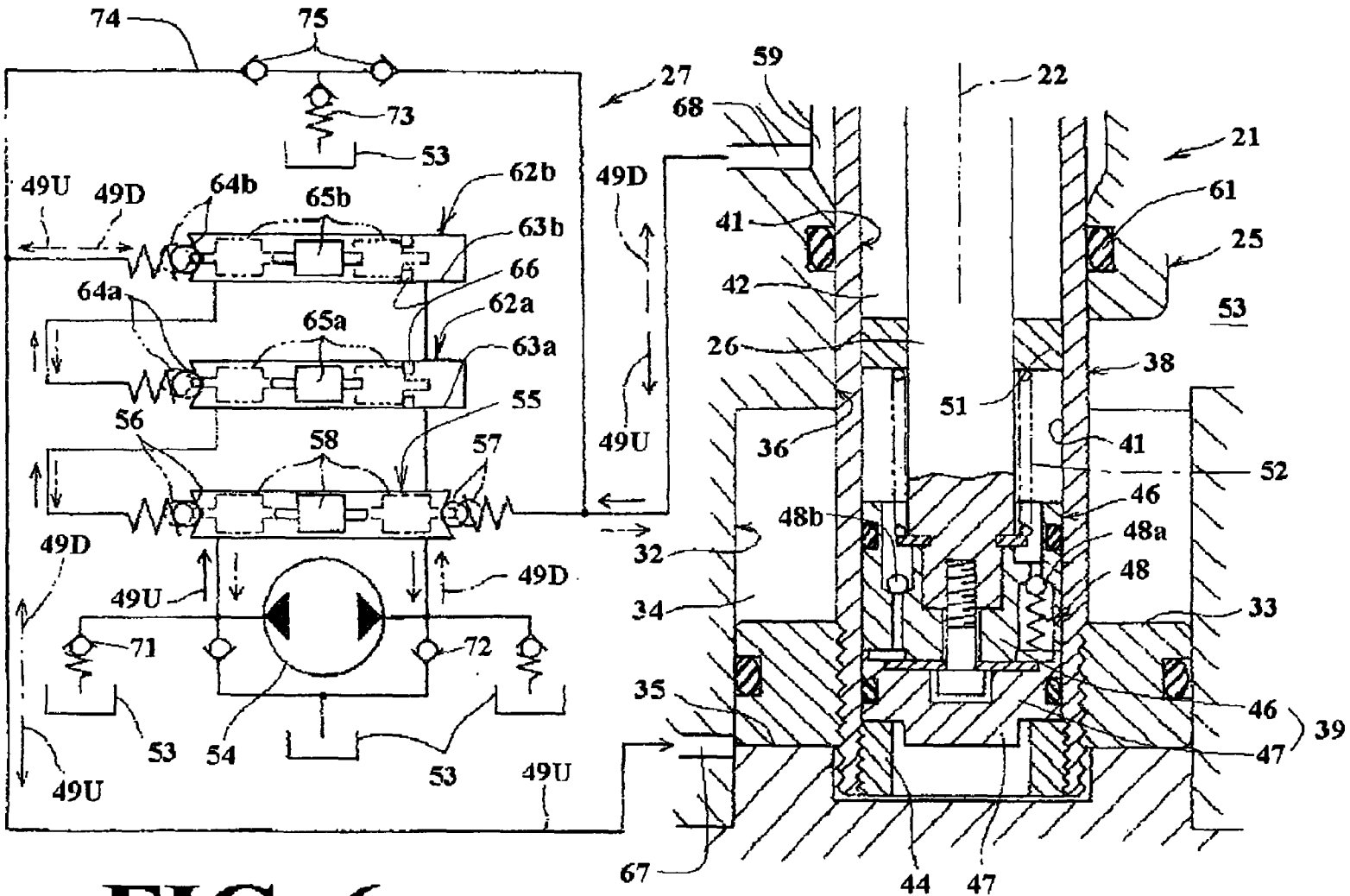
FIG. 6 is an enlarged and in part schematic view showing the hydraulic system and the unit in the position shown in FIG. 3.

Referring now primarily to FIG. 6, the hydraulic control system 27 is contained in part within the housing 28 which is fixedly attached to the cylinder body 25 and in this cylinder body 25. It includes a reversible hydraulic pump 54 driven, for example by the aforenoted reversible electric motor contained within the housing 28 for drawing, pressurizing and discharging oil 49 contained in an oil reservoir, shown schematically at 53, formed within the cylinder body 25 and which communicates with the upper chamber 34 of the large diameter cylinder bore 32.

As is typical with the prior art and as is shown in my aforenoted co-pending applications, a shuttle valve assembly, indicated generally by the reference numeral 55, is interposed between the pump 54 and the various piston chambers for controlling the tilt and trim movement as will be described. The shuttle valve assembly includes, as is well known in the art, a first check valve 56 for controlling the flow to and from the lower chamber 35 of the large cylinder bore 32 and the smaller cylinder bore 41 provided below the pistons 46 and 47 of the small piston 39. In addition the shuttle valve assembly 55 includes a second check valve 57 for controlling the flow to and from the upper bore portion 42 of the smaller cylinder bore 41 through a recess 59 formed in the cylinder body 25 above the large bore 32. An O ring 61 seals the cylinder tube 38 in the area between the recess 59 and the upper portion of the larger bore 32. The shuttle valve assembly 55 also includes, as is well known, a shuttle piston 58 to pressure open the first and second check valves 56 and 57 depending on the direction the pump 54 is driven.

The construction as thus far described is conventional. However and in accordance with the invention, one or more modified shuttle valves (two are illustrated) indicated by the reference numeral 62 (62*a* and 62*b* in the illustrated embodiment) are interposed between the circuit between the shuttle valve 55 and the chambers of the tilt and trim cylinder 21, for a reason that will become apparent shortly. The components of the respective modified shuttle valves 62 will be identified by like subscripts.

Each valve 62 is formed with a cylinder bore 63 that is closed at one end. The other end of the cylinder bores 63 is closed by a check valve 64 that is spring biased to a closed position, as shown in solid lines. A shuttle piston 65 is slidable in each cylinder bore 63 for pressure opening the respective check valve. Finally a stop ring 66 is provided in each cylinder bore 63 for limiting the movement of the shuttle piston 62 toward the closed end of the cylinder bore 63. The shuttle valve 55 and modified shuttle valves 62 are arranged so that their check valves 56 and 64 are in a series flow arrangement between the pump 54 and the lower chamber of at least one of the piston 33 and the piston assembly 39 so that when the system is not pressurized the possibility of leaking down due to wear or valve sticking is reduced if not totally prevented.

To achieve trim and, if desired, tilt up operation from the fully down position shown in FIG. 3, the reversible motor driving the pump 54 is operated to drive the pump 54 to pressurize the oil 49 for flow in the direction of the solid line arrows represented by the reference characters 49U in FIGS. 3–5. This pressurizes the left hand side of the shuttle piston 58 causing it to shift to the right as best seen in FIG. 3 to unseat the check valve 57. At the same time the pressure in the shuttle valve 55 opens the check valve 56.

Then the oil can flow through the aforenoted series connection between the shuttle valve 55 and the modified shuttle valves 62 and then flows through a conduit shown in part schematically and indicated by the reference numeral 67 to the lower bore portion 35 to drive the large trim piston 33 upwardly in the large diameter cylinder bore 32 to trim up the outboard motor propulsion unit 16 in the direction of the arrow A in FIG. 1.

During this trimming up operation, the valves 48*a* and 48*b* will remain closed and the tilt or small piston 39 assembly will move in unison with the large piston 33 until the position shown in FIGS. 4 and 5 is reached. This upward movement of the pistons 33 and 39 displaces fluid from both the upper chamber 34 directly to the reservoir 53 and from the recess 59 back to the inlet side of the pump 54 through a conduit shown in part schematically at 68 and in the direction of the solid arrows 49U and the check valve 57 which, as previously noted, has been opened by the action of the shuttle piston 58. At this time the shuttle pistons 65 of the modified shuttle valves 62 will be shifted to the right against the stop rings 66. Conduits interconnect these areas and with the area to the left of the check valve 57 for a reason to be described. Because of the area occupied by the cylinder tube 38 and the piston rod 26 less fluid will be displaced than is required for the upward movement and make up fluid can be drawn from the reservoir 53 through a check valved passage indicated in FIG. 6 at 69.

If tilt up operation is required, the motor and pump 54 are operated in the same direction as for trimming up and if the large piston 33 is not in the fully trimmed up position the operation is continued until the fully trimmed up position of FIG. 4 is reached. Then continued operation of the pump 54 is maintained. Since the large piston 33 can no longer move, all of the pumped fluid will be delivered to the lower bore area 42*b* and the piston assembly 39 will continue to move, but at a much faster rate due to its lower effective area, but without as much force as provided by the large piston 33. A positive external stop (not shown) determines this position. Alternatively, contact of the oil lock piston 51 with the upper stopper ring 45 may be employed to set the fully tilted up position. If the operation of the pump 54 is continued after the fully tilted up position is reached, a tilt up relief valve 71 (FIG. 6) will open to bypass the fluid to avoid damage.

Trim and/or tilt down is achieved by operating the pump 54 in the opposite direction and the fluid flow will be in the direction of the broken arrows in FIG. 6. Initially only the small piston assembly 39 and the connected piston rod 26 will move downwardly until the stopper ring 44 is engaged as shown in FIG. 4 and then the trim or large piston 33 will move downwardly with the cylinder tube 38 until the desired trim position is reached. If not stopped earlier a trim down relief valve 72 will open when fully tilted and trimmed down to prevent damage.

It should be noted that during this downward operation the shuttle piston 58 of the shuttle valve 55 will be shifted to the left as shown in FIG. 6 when the fluid pressure opens the check valve 57 to effect flow in the passage 68 in the direction of the broken arrows 49D. This will open the shuttle valve check valve 56. At the same time, fluid flows through series connection passages from the chamber of the shuttle valve 55 to the left of the check valve 57 to like chambers in the modified shuttle valves 62 to shift their shuttle pistons to the left to open the valves 64 so that return flow to the inlet side of the pump 54 from the passage 67 is possible as shown by the arrows 49D.

Continuing to refer to FIG. 6 it will be seen that a manual valve, indicated by the reference numeral 73, is disposed in a conduit 74 that interconnects the conduits 67 and 68. This valve is disposed between a pair of oppositely operated check valves 75 and when opened permits both conduits 67 and 68 to communicate with the reservoir 53 so that the propulsion unit 16 may be manually moved to a desired tilt or trim position without resistance from the hydraulic system.

The action in which the system operates to permit popping up from any set trim position is permitted when an underwater obstacle is encountered, how the popping up action is damped to a stop and the propulsion unit 16 can return to the trim adjusted position when the obstacle is cleared is described in detail in my aforenoted co-pending applications and further discussion here is not believed necessary to permit those skilled in the art to practice the invention described here.

As has been previously noted, when the trim cylinder is operated to expand/retract in order to adjust the trim position of the propulsion unit, the propulsion unit swings up and down as the piston repeatedly slides with respect to the inner peripheral surface of the cylinder bore through the sealing body with friction. The same occurs during repeated tilt up and down operations as well as popping up and return operations as occur when underwater obstacles are encountered and cleared. Therefore, extended and repeated use of the unit may often produce a minute foreign matter resulting from the wearing of the inner peripheral surface of the cylinder bore or the sealing body.

The fluid control system including the shuttle valve assembly that incorporates a pair of oppositely opening check valves may be affected by this foreign matter by either cause pitting of the ball check valves, wear of their seats or become lodged between the desired sealing surfaces. This can result in minute leakage that will cause the propulsion unit to gradually move from its desired position, an obviously unsatisfactory condition. Although frequent servicing of the unit and inspection could avoid this problem, this is not always done and can be expensive. However by employing the added modified shuttle valves in series flow relation on the down flow side of the system, if one valve is prone to leakage for the aforenoted reasons, the other one or ones will still prevent such leakage and the propulsion unit will be maintained in position as long as desired, thus eliminating the problem and avoiding the necessity of frequent servicing. Of course those skilled in the art will readily understand that the described embodiments are only exemplary of forms that the invention may take and that various changes and modifications may be made without departing from the spirit and scope of the invention, as defined by the appended claims.

What is claimed is:

1. A hydraulic system for controlling the position of an outboard drive on the hull of a watercraft, said system comprising a cylinder body assembly defining a cylinder bore in which a piston is supported for reciprocation and divides said cylinder bore into two chambers on opposite sides of said piston, a piston rod affixed to said piston and extending through one of said chambers and externally of said cylinder body assembly for connection to one of said outboard drive and said hull, the cylinder body assembly being connected to the other of said outboard drive and said hull for effecting movement of said outboard drive relative to said hull upon pressurization of one of said chambers, and a hydraulic system for selectively pressurizing said one chamber to elevate said outboard drive relative to said hull, said hydraulic system comprising a pump for pressurizing fluid and a valved system for communicating the output of said pump with said one chamber comprising a first check valve interposed between said pump and said one chamber and adapted to be opened upon pressurization for flow toward said one chamber and a second check valve interposed between said first check valve and said one chamber and in series flow relation to said first check valve and adapted to be opened upon pressurization for flow toward said one chamber, either of said first and said second check valves precluding flow from said one chamber when not pressurized.

2. A hydraulic system as set forth in claim 1 wherein the fluid pump is reversible and the first check valve is a part of a shuttle valve comprised of oppositely acting check valves one of which comprises said first check valve and a shuttle piston disposed between said pair of cheek valves, the opposite sides of said shuttle piston communicating with the opposite sides of said pump for selective pressurization thereof depending on the direction of operation of said fluid pump.

3. A hydraulic system as set forth in claim 2 wherein the second check valve comprises a portion of a modified shuttle valve having only said second check valve and a modified shuttle valve piston disposed in a closed end bore with said second check valve disposed at the end of said bore opposite said closed end, the area between said second check valve and said modified shuttle valve piston being in communication with the area between said first check valve and the one chamber.

4. A hydraulic system as set forth in claim 3 wherein the area between the modified shuttle valve piston the closed end of the bore is in open communication with the area between the shuttle piston and the other of the pair of check valves of the shuttle valve.

5. A hydraulic system as set forth in claim 2 further including a third check valve interposed between the second check valve and the one chamber and adapted to be opened upon pressurization for flow toward said one chamber, each of said first, said second and said third check valves precluding flow from said one chamber when not pressurized.

6. A hydraulic system for controlling the position of an outboard drive on the hull of a watercraft, said system comprising a cylinder body assembly defining a cylinder bore in which a piston is supported for reciprocation and divides said cylinder bore into two chambers on opposite sides of said piston, a piston rod affixed to said piston and extending through one of said chambers and externally of said cylinder body assembly for connection to one of said outboard drive and said hull, the cylinder body assembly being connected to the other of said outboard drive and said hull for effecting movement of said outboard drive relative to said hull upon pressurization of one of said chambers, and a hydraulic system for selectively pressurizing said one chamber to elevate said outboard drive relative to said hull, said hydraulic system comprising a pump for pressurizing fluid and a valved system for communicating the output of said pump with said one chamber comprising a first check valve interposed between said pump and said one chamber and adapted to be opened upon pressurization for flow toward said one chamber and a second check valve interposed between said first check valve and said one chamber adapted to be opened upon pressurization for flow toward said one chamber, a third check valve interposed between said second check valve and said one chamber and adapted to be opened upon pressurization for flow toward said one chamber, each of said first, said second and said third check valves precluding flow from said one chamber when not pressurized, said third check valve comprising a portion of a second modified shuttle valve having only said third check valve and a modified shuttle valve piston disposed in a closed end bore with said third check valve disposed at the end of said second bore opposite said closed end, the area between said third check valve and said modified shuttle valve piston being in communication with the area between said second check valve and the one chamber.

7. A hydraulic system as set forth in claim 6 wherein the area between the second modified shuttle valve piston and the closed end of the second bore is in open communication with the area between the modified shuttle piston and the closed end of the bore in which said modified shuttle piston is positioned.

8. A hydraulic system as set forth in claim 7 wherein the second check valve comprises a portion of a modified shuttle valve having only said second check valve and a modified shuttle valve piston disposed in a closed end bore with said second check valve disposed at the end of said bore opposite said closed end, the area between said second check valve and said modified shuttle valve piston being in communication with the area between said first check valve and the one chamber.

* * * * *